United States Patent [19]

Taikawa

[11] Patent Number: 4,647,936

[45] Date of Patent: Mar. 3, 1987

[54] SLEWING ASSEMBLY

[75] Inventor: Takashi Taikawa, Okayama, Japan

[73] Assignee: Ting-I Lin, Hsin Chuang, Taiwan; a part interest

[21] Appl. No.: 778,863

[22] Filed: Sep. 23, 1985

[30] Foreign Application Priority Data

Sep. 26, 1984 [JP] Japan ..... 59-146089[U]

[51] Int. Cl.[4] ..... H01Q 1/22; H01Q 3/12

[52] U.S. Cl. ..... 343/702; 343/882; 343/888

[58] Field of Search ..... 343/702, 880, 882, 888, 343/900, 763

[56] References Cited

U.S. PATENT DOCUMENTS

| | | | |
|---|---|---|---|
| 3,479,107 | 11/1969 | Blythe et al. | 343/763 |
| 3,624,662 | 11/1971 | Feder | 343/882 X |
| 4,074,271 | 2/1978 | Sakuma | 343/882 |
| 4,173,761 | 11/1979 | Liaufund | 343/900 X |
| 4,491,846 | 1/1985 | Buse et al. | 343/882 X |
| 4,525,718 | 6/1985 | Imazeki et al. | 343/702 |

FOREIGN PATENT DOCUMENTS

| | | | |
|---|---|---|---|
| 0590837 | 4/1978 | U.S.S.R. | 343/702 |

*Primary Examiner*—Daniel M. Yasich
*Attorney, Agent, or Firm*—Charles L. Lovercheck; Wayne L. Lovercheck; Dale R. Lovercheck

[57] ABSTRACT

A slewing assembly comprises a cylindrical main body and a shackle member, it is characterized that the cylindrical main body includes a pedestal-like member with a terminal to be connected to a radio set or the like and a hollowed cylindrical section for rotatably receiving the shackle member; the shackle member comprises a forked portion containing a slot and a screw hole for pivotally securing an extensile rod antenna or the like and a hollowed cylindrical section to be rotatably received in the hollowed section of the main body, a plurality of grooves surrounding the outer surface thereof are provided for lubricating purpose, one slit extends axially on the entire outer surface of the same, the other one slit extends more than a hemicircumference around the outer surface of the same at the end abutting against the flange of the forked portion, said two slits intersect at right angle to form an integral cross slit so that the hollowed cylindrical section of the shackle member is contractable and expandable; when the hollowed cylindrical section of the shackle member is suitably received in the hollowed cylindrical section of the main body, the opening margin of the hollowed cylindrical section of the main body above the flange of the forked portion of the shackle member is pressed against said flange, the shackle member accordingly will be smoothly rotated without coming off the main body with steady and unfluctuated rotation torque.

1 Claim, 4 Drawing Figures

SLEWING ASSEMBLY

BACKGROUND OF THE INVENTION

The present invention relates to the improvements of the conventional slewing assembly, particularly to the improvements of the slewing assembly for a telescopic rod antenna.

The conventional slewing assembly generally comprises a cylindrical main body, a shackle member and a sleeve. The cylindrical main body includes a pedestal with a terminal to be connected to a radio set or the like and a hollowed cylindrical section for rotatably receiving the shackle member. Two slits are formed on the outer surface of the hollowed cylindrical section of the main body, wherein one of the two slits extends axially on the entire outer surface thereof, the other one extends around the outer circumference thereof at the end abutting against the pedestal of the main body. These two slits intersect at a right angle to constitute an integral cross slit. The shackle member comprises a forked portion for pivotally securing a telescopic rod antenna and a cylindrical section to be rotatably received in the hollowed cylindrical section of the main body, a plurality of grooves surrounding the outer surface thereof are provided for lubricating purpose. The cylindrical main body and the shackle member with the exception of the forked portion are encased by means of a sleeve when the cylindrical section of the shackle member is rotatably received in the hollowed cylindrical section of the main body. A groove interengageable with a preformed groove on the pedestal of the main body is then formed and caulked with pressing rollers on the outer surface of the sleeve. For prevention of disengagement, four-point punching holes pierced with four gimlets of the sleeve.

The conventional slewing assembly comprises the following disadvantages:

1. It is costly due to the sleeve is made of brass,
2. Manufacture and assembling of the components thereof are troublesome and tedious,
3. The chromeplated layer on the sleeve is susceptible to being stripped off when it is grooved and caulked with rollers or pierced with gimlets,
4. No smooth rotational torque is available because the circularity of hollowed cylindrical section of the main body is susceptible to being deformed when the shackle member is received therein.

Therefore, it is the object of the present invention to remove the above described disadvantages inherent in the conventional slewing assembly. The improvements are based on the experience of the present inventor who has been dealing with various antennas for more than twenty years. The slewing assembly of the present invention is constructed of fewer and simpler components in comparison with conventional slewing assemblies and thereby provides a much simpler structure. In this regard, manufacture and assembly of the components thereof become more easier and timesaving, as a result, mass production with higher quality makes the cost of the present slewing asembly greatly reduced.

BRIEF DESCRIPTION OF THE DRAWINGS

Other objects, features and advantages of the present invention shall become apparent as the description thereof proceeds when considered in connection with the accompanying illustrated drawings, wherein.

DETAILED DESCRIPTION OF THE PREFERRED EMBODIMENT

Figure 1:
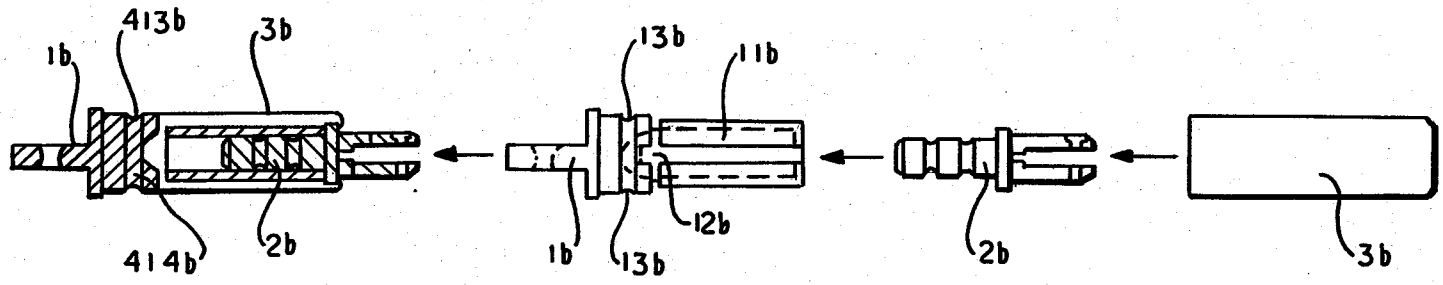
FIG. 1 is the exploded view and assembled view of the conventional slewing assembly for a telescopic rod antenna.
Figure 2:
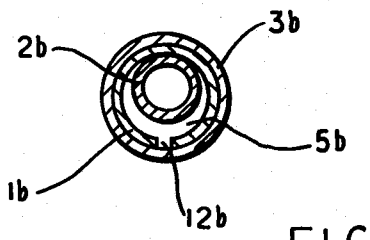
FIG. 2 is an enlarged sectionalized view of the conventional slewing assembly illustrated in FIG. 1.

As illustrated in FIGS. 1 and 2, the conventional slewing assembly for connecting a foldable radio antenna to a radio, television or other electronic device by means of a universal joint generally comprises a cylindrical main body 1*b*, a shackle member 2*b* and a sleeve 3*b*. The cylindrical main body 1*b* includes a pedestal-like member with a terminal to be connected to a foldable antenna to a radio set (not shown) and a hollowed cylindrical section 11*b* for rotatably receiving the shackle member 2*b*. Two slits are formed on the outer surface of the hollowed cylindrical section 11*b* of the main body 1*b*, wherein one of the two slits extends a little more than a hemi-circumference axially on the entire surface thereof, while the other one extends around the outer circumference thereof at the end abutting against the pedestal-like member of the main body 1*b*, these two slits intersect at right angle to constitute an integral cross slit 12*b*.

The shackle member 2*b* comprises a forked portion for pivotally securing a telescopic rod antenna (not shown) and a cylindrical section 11*b* of the main body 1*b*, a plurality of grooves surrounding the outer surface thereof are provided for lubricating purpose. The cylindrical section 11*b* of the main body 1*b* and the shackle member 2*b* with the exception of the forked section are encased by means of sleeve 3*b* when the cylindrical section of the shackle member 2*b* is received in the hollowed cylindrical section 11*b* of the main body 1*b* of the main body 1*b*. A groove 413*b* interengageable with the preformed groove 13*b* formed and caulked on the outer surface of the sleeve 3*b*. For prevention of disengagement, four-point punching 414*b* must be provided in the groove 413*b* of the sleeve 3*b* as illustrated in 1-4 of FIG. 1.

Figure 3:
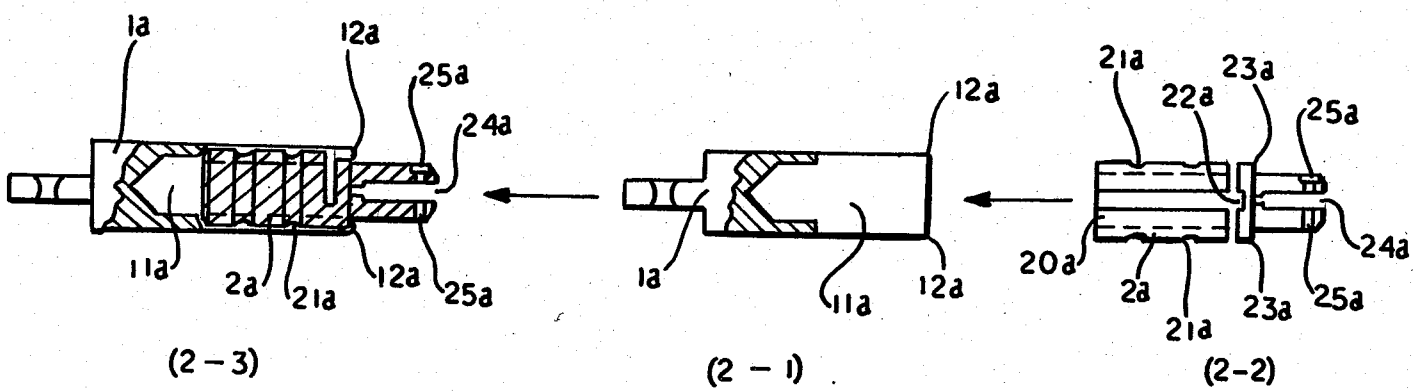
FIG. 3 is the exploded view and assembled view of the present slewing assembly.
Figure 4:
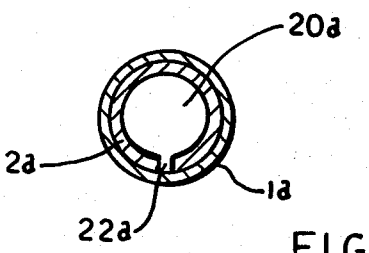
FIG. 4 is an enlarged sectionalized view of the present slewing assembly illustrated in FIG. 3.

Now referring to FIGS. 3 and 4 showing the constitution of the present slewing assembly. It is characterized that the present slewing assembly merely comprises a cylindrical main body 1*a* and a shackle member 2*a*. As illustrated in 2-1 of FIG. 3, the cylindrical main body 1*a* includes a pedestal with a terminal to be connected to a radio set (not shown) or the like and a hollowed cylindrical section 11*a* for rotatably receiving the shackle member 2*a*.

As illustrated in 2-2 of FIG. 3, the shackle member 2*a* comprises a forked portion containing a slot 24*a* and a screw hole 25*a* pivotally securing an extensile rod antenna (not shown) or the like and a hollowed cylindrical section 20*a* of the main body 1*a*, a plurality of grooves 21*a* surrounding the outer surface thereof are provided for lubricating purpose. Two slits are formed on the outer surface of the hollowed cylindrical section 20*a* of the shackle member, wherein one of the two slits extends axially on the entire outer surface thereof, while the other one extends more than a hemi-circumference around the outer circumference thereof at the end abutting against the flange 23*a* of the forked portion. These two slits intersect at right angle to constitute an integral cross slit 22*a* so that it is contractable and expandable. Slightly expand the hollow cylindrical section 20*a* of the shackle member 2*a* prior to engagement in the hollowed cylindrical section 11*a* of the main body 1*a*. When the hollowed cylindrical section 20*a* of the shackle member 2*a* is suitably received in the hollowed cylindrical section 11*a* of the main body 1*a*, as illustrates in 2–3 of FIG. 3, the opening margin 12*a* of the hollowed cylindrical section 11*a* above the flange 23*a* of the forked portion of the shackle member 2*a* is then pressed against the flange 23*a*. It is seen, with the above-described constitution, the shackle member 2*a* of the present slewing assembly may be easily engaged and firmly retained in the main body 1*a*, while it may be smoothly rotated without coming off the main body 1*a*.

In comparison with the conventional slewing assembly, the present slewing assembly is constructed of fewer and simpler components, thus products with higher precision and quality are obtainable, while the costs are greatly reduced. It is most clearly illustrated in FIG. 1, the conventional slewing assembly has the cross slit 12*b* formed on the hollowed cylindrical section 11*b* of the main body 1*b*, whereas the slit around the circumference thereof just extends a hemi-circumference of the hollowed cylindrical section 11*b*, the main body 1*b* may be elliptically squeezed to form a clearance 5*b* as illustrated in FIG. 2 when the hollowed cylindrical section of the shackle member 2*b* is received in the cylindrical section 11*b* of the main body 1*b*, because of the outside diameter of the cylindrical section of the shackle member 2*b* must be made slightly bigger than the inside diameter of the hollowed cylindrical section 11*b* of the main body 1*b* before the slit 12*b* is formed on the outer surface thereof in order to firmly retaining the shackle member 2*b* in the main body 1*b*. In other words, the circularity of inner wall of the hollowed cylindrical section 11*b* of te main body 1*b* will extend radially (outwardly) and will be deformed when the cylindrical section of shackle member 2*b* is received in the hollowed cylindrical section 11*b* of the main body 1*b*. The main body 1*b* will be squeezed to an elliptical shape and formed a clearance 5*b* on the axially slitted portion when the shackle member 2*a* is received therein. In this regard, smooth rotation torque is not available due to the clearance 5*b* when the shackle member 2*b* is rotated with a rod antenna. The directional fluctuation of rotation torque can be measured with a Torque Meter in kg/cm when the shackle member 2*b* is rotated with a telescopic rod antenna. On the contrary, the present slewing assembly has the cross slit 22*a* formed on the hollowed cylindrical section 20*a* of the shackle member 2*a*, in addition, the outside diameter thereof and the inside diameter of the hollowed cylindrical section 11*a* of the main body 1*a* both have the same dimensions. When the shackle member 2*a* is suitably received in the hollowed cylindrical section 11*a* of the main body 1*a* with the opening margin 12*a* well pressed against the flange 23*a* of the shackle member 2*a*, the hollowed cylindrical section 20*a* of the shackle member 2*a* has been expanded in advance (with a tool) radially because of the cross slit 22*a*, as a result, the outer surface of the hollowed section 20*a* will be closely contiguous to the circular inner surface of the hollowed section 11*a* of the main body 1*a* as illustrated in FIG. 4, apparently, the shackle member 2*a* will be smoothly rotated in the main body 1*a* with steady and unfluctuated rotation torque.

While there is shown and described herein a specific structure embodying the invention, it will be manifest to those skilled in the art that various modifications and rearrangements of the parts may be made without departing from the spirit and scope of the underlying inventive concept and that the same is not limited to the particular form herein shown and described except insofar as indicated by the scope of the appended claim.

The embodiments of the invention in which an exclusive property or privilege is claimed are defined as follows:

1. A slewing assembly for providing a universal joint connecting a terminal of an antenna to an electronic radio device comprising a hollow cylindrical main body and a shackle member, said hollow cylindrical main body having a closed end and an open end, a blade-like pedestal-like member fixed to said closed end of said hollow cylindrical main body, said blade-like pedestal-like member having two generally parallel sides and a screw hole extending from one said side to the other for attaching said slewing assembly to the radio terminal, said shackle member having a hollow cylindrical portion received in said hollow cylindrical main body and a forked end integrally attached to said cylindrical portion of said shackle member, peripherial grooves in said cylindrical portion of said shackle in the outer surface thereof for lubrication, an axially extending slot in said forked portion extending from said cylindrical portion of said shackle to the end thereof remote from said cylindrical portion, said axially extending slot being adapted to receive an end of an antenna, a hole extending through said forked portion and adapted to receive clamping means to clamp an antenna in said slot in said forked member, an interior cross slot formed in said cylindrical part of said shackle member intersecting the hollow therein, said hollow cylindrical part of said shackle member terminating in a shoulder flange, the ends of said hollow portion being adapted to overlie said flange and being deformed over said flange holding said shackle member from being released from said body whereby said shackle member may be smoothly rotated relative to said main body.

* * * * *